US009175845B2

(12) United States Patent
Wepfer et al.

(10) Patent No.: US 9,175,845 B2
(45) Date of Patent: Nov. 3, 2015

(54) AXIAL FLOW STEAM GENERATOR FEEDWATER DISPERSION APPARATUS

(75) Inventors: Robert M. Wepfer, Export, PA (US); Walter P. Wojick, Chattanooga, TN (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 602 days.

(21) Appl. No.: 13/545,302

(22) Filed: Jul. 10, 2012

(65) Prior Publication Data

US 2014/0014048 A1 Jan. 16, 2014

(51) Int. Cl.

| | |
|---|---|
| ***F22G 5/12*** | (2006.01) |
| ***F22B 37/48*** | (2006.01) |
| ***F22B 1/16*** | (2006.01) |
| ***F22B 37/22*** | (2006.01) |
| ***F22D 1/02*** | (2006.01) |

(52) U.S. Cl.

CPC ..... *F22B 1/162* (2013.01); *F22B 37/22* (2013.01); *F22D 1/02* (2013.01)

(58) Field of Classification Search

CPC ..... B05B 15/069; F28G 7/00; F22G 5/12; F22B 1/025

USPC ..... 122/487, 34; 137/561 A; 138/41

See application file for complete search history.

(56) References Cited

U.S. PATENT DOCUMENTS

| | | | | |
|---|---|---|---|---|
| 1,007,449 | A * | 10/1911 | Keyes | 210/442 |
| 2,548,788 | A * | 4/1951 | Helme | 239/110 |
| 2,605,140 | A * | 7/1952 | Bartling | 239/590.3 |
| 2,645,099 | A * | 7/1953 | Cumming | 62/511 |
| 3,363,616 | A * | 1/1968 | Baumgarten | 123/198 R |
| 3,425,632 | A * | 2/1969 | Stout | 239/267 |
| 3,991,720 | A | 11/1976 | Byerley | |
| 4,302,338 | A * | 11/1981 | Pfohl et al. | 210/752 |
| 4,502,419 | A | 3/1985 | Smith, Jr. | |
| 4,511,089 | A * | 4/1985 | Ebata et al. | 239/553.3 |
| 4,681,129 | A * | 7/1987 | Juzi et al. | 137/154 |
| 4,807,801 | A * | 2/1989 | Nakamura | 148/520 |
| 4,816,155 | A * | 3/1989 | Linderman | 210/459 |
| 5,095,930 | A * | 3/1992 | Stroszynski et al. | 137/1 |

(Continued)

OTHER PUBLICATIONS

International Search Report for PCT/US2013/047479 dated Nov. 15, 2013 (Form PCT/ISA/210).

(Continued)

*Primary Examiner* — Steven B McAllister
*Assistant Examiner* — Rabeeul Zuberi
(74) *Attorney, Agent, or Firm* — Richard J. Coldren; Westinghouse Electric Company LLC

(57) ABSTRACT

A feedring for use with an axial flow preheat steam generator which utilizes a double wrapper to direct feedwater flow to the cold leg tube bundle region. The feedring is positioned directly over the double wrapper and includes a plurality of standpipes spaced circumferentially along the feedring. The standpipes respectively extend vertically from a lower portion of an interior of the feedring upward through the interior of the feedring. The standpipes have a feedwater intake in the upper portion of the feedring to minimize the potential for vapor formation and bubble collapse water hammer. The components of the standpipe are arranged to minimize the transmission of entrained loose parts from traveling with the feedwater to the tube bundle. A feedwater discharge is provided at the exit of the standpipe at or below the bottom of the feedring, for evenly distributing the feedwater into the double wrapper downcomer.

17 Claims, 11 Drawing Sheets

(56) References Cited

U.S. PATENT DOCUMENTS

| | | | | |
|---|---|---|---|---|
| 5,264,036 | A * | 11/1993 | Haas et al. | 118/315 |
| 5,290,152 | A * | 3/1994 | Wallace et al. | 417/68 |
| 5,334,352 | A * | 8/1994 | Johnson | 422/500 |
| 5,335,629 | A * | 8/1994 | Cornic | 122/32 |
| 5,785,361 | A | 7/1998 | Bourbour et al. | |
| 5,988,521 | A * | 11/1999 | Nohynek | 239/11 |
| 6,058,968 | A * | 5/2000 | Carter | 137/561 A |
| 6,173,680 | B1 | 1/2001 | Dague et al. | |
| 6,460,568 | B1 * | 10/2002 | Goodwin | 137/561 A |
| 7,261,120 | B2 * | 8/2007 | Muller | 137/154 |
| 7,434,546 | B2 * | 10/2008 | Prabhu et al. | 122/379 |
| 2008/0006643 | A1 * | 1/2008 | Ma | 220/592.16 |
| 2009/0092216 | A1 | 4/2009 | Hu | |
| 2010/0034334 | A1 * | 2/2010 | Petit-Jean | 376/260 |

OTHER PUBLICATIONS

Written Opinion of the International Searching Authority for PCT/US2013/047479 dated Nov. 15, 2013 (Form PCT/ISA/237).

International Preliminary Report on Patentability for PCT/US2013/047479 dated Jan. 22, 2015 (Forms PCT/IB/326, PCT/IB/373, PCT/ISA/237).

* cited by examiner

AXIAL FLOW STEAM GENERATOR FEEDWATER DISPERSION APPARATUS

BACKGROUND

1. Field

This invention relates generally to U-tube steam generators and, more particularly, to such generators that disperse feedwater into a downcomer between a wrapper and the steam generator shell.

2. Description of Related Art

A pressurized water nuclear reactor steam generator typically comprises a vertically oriented shell, a plurality of U-shaped tubes disposed in the shell so as to form a tube bundle, a tube sheet for supporting the tubes at the ends opposite the U-like curvature, a divider plate that cooperates with the tube sheet and a channel head forming a primary fluid inlet header at one end of the tube bundle and a primary fluid outlet header at the other end of the tube bundle. A primary fluid inlet nozzle is in fluid communication with the primary fluid inlet header and a primary fluid outlet nozzle is in fluid communication with the primary fluid outlet header. The steam generator secondary side comprises a wrapper disposed between the tube bundle and the shell to form an annular chamber made up of the shell on the outside and the wrapper on the inside and a feedwater ring disposed above the U-like curvature end of the tube bundle.

The primary fluid having been heated by circulation through the reactor enters the steam generator through the primary fluid inlet nozzle. From the primary fluid inlet nozzle, the primary fluid is conducted through the primary fluid inlet header, through the U-tube bundle, out the primary fluid outlet header and through the primary fluid outlet nozzle to the remainder of the reactor coolant system. At the same time, feedwater is introduced into the steam generator secondary side, i.e., the side of the steam generator interfacing with the outside of the tube bundle above the tube sheet, through a feedwater nozzle which is connected to a feedwater ring inside the steam generator. In one embodiment, upon entering the steam generator, the feedwater mixes with water returning from moisture separators. This mixture, called the downcomer flow, is conducted down the annular chamber adjacent the shell until the tube sheet located at the bottom of the annular chamber causes the water to change direction passing in heat transfer relationship with the outside of the U-tubes and up through the inside of the tube wrapper. While the water is circulating in heat transfer relationship with the tube bundle, heat is transferred from the primary fluid in the tubes to water surrounding the tubes causing a portion of the water surrounding the tubes to be converted to steam. To differentiate the steam/water mixture from the single phase downcomer flow, the fluid flow surrounding the tubes is designated as the tube bundle flow. The steam then rises and is conducted through a number of moisture separators that separate entrained water from the steam and the steam vapor then exits the steam generator and is typically circulated through a turbine to generate electricity in a manner well known in the art.

The U-shaped heat exchange tubes of such steam generators are typically described as having a hot leg, which is directly in fluid communication with the primary fluid inlet header and a cold leg which is directly in fluid communication with the primary fluid outlet header. A number of these types of steam generators preheat the downcomer flow by passing the cooler portions of the downcomer flow by the cold legs of the tube bundle to increase the log mean temperature difference and thereby enhance heat transfer. This is accomplished by employing a partition plate which extends across the tube sheet through a center tube lane between the hot legs and cold legs of the heat exchange tubes. The partition plate extends axially up between the tubes from the tube sheet to an elevation below the U-bends. In this preheat class of steam generators, the downcomer region typically extends less than 180° around the cold legs side of the wrapper and is partitioned to separate the downcomer region from the circumferential area around the wrapper that surrounds the hot legs. A nearly semicircular feedwater distribution ring is supported above the cold leg downcomer region in the partitioned area between the shell and the wrapper, so that the feedwater is distributed down the outside of the wrapper surrounding the cold legs, underneath the wrapper at the tube sheet and up and around the cold legs of the heat exchange tubes.

Axial flow preheat steam generator feedrings must evenly distribute feedwater flow over approximately 160° of a steam generator's upper shell circumference. As explained above, this serves to introduce the colder feedwater into the cold leg side of the tube bundle, whereby the preheating benefit of increased heat transfer occurs. Prior art reference, U.S. Pat. No. 6,173,680, accomplished this objective utilizing a large inverted duct to direct and distribute flow into the downcomer, and included a loose parts screen within the feedring, which requires access through bolted flanges.

An improved feedwater distribution ring is desired that provides a much lower pressure drop loose parts screening arrangement with enhanced access features.

Furthermore, such a feedwater feedring design is desired that will accomplished substantially even feedwater distribution over the cold leg downcomer, using a more compact arrangement.

SUMMARY

The foregoing objectives are achieved by a steam generator having a primary side including an inlet chamber for receiving heated primary fluid and an outlet chamber for returning the primary fluid to a heating source. A tube sheet forms at least one wall of the inlet chamber and at least one wall of the outlet chamber. A plurality of heat exchange tubes respectively having first and second ends and an intermediate extent, have the first ends extending through the tube sheet and opening into the inlet chamber and the second ends extending through the tube sheet and opening into the outlet chamber, with the intermediate extent passing through and in heat exchange relationship with the secondary side of the steam generator. The secondary side includes a generally cylindrical outer shell having a central axis and a generally cylindrical wrapper supported above at least a portion of the tube sheet, within, spaced from and co-axially positioned with the shell so as to form a downcomer region between at least part of the wrapper and the shell. A nearly semicircular feedring is positioned above the cold leg downcomer region for introducing feedwater into the downcomer region. A plurality of standpipes are spaced circumferentially along the feedring, extending vertically from a lower portion of an interior of the feedring upward through the interior of the feedring. The standpipes have a feedwater intake in the upper portion of the interior of the feedring and a feedwater discharge at or below a bottom of the feedring, for distributing the feedwater into the downcomer region.

In one embodiment, the steam generator includes a spray nozzle suspended within the standpipe. Preferably, the spray nozzle is a generally tubular member with perforated sidewalls, a closed lower end and an intake near the upper portion of the interior of the feedring. Desirably, the perforations in the spray nozzle sidewalls are arranged substantially uniformly over the sidewall and are spaced from an opposing interior sidewall of the standpipe. In one embodiment, portions of the sidewalls of the spray nozzle converge towards an opposing wall of the spray nozzle as the walls of the spray nozzle extend towards its lower end. Preferably, a lower portion of the spray nozzle is supported from the opposing interior sidewalls of the standpipe. In the one embodiment, the nozzle is supported from the top of the standpipe and the perforations are sized to trap debris of a preselected size.

In still another embodiment, the feedring includes a port housing having walls that extend upward from a top of the feedring, in line with the spray nozzle and through which the spray nozzle can be serviced. Preferably, a top of the port housing is sealed with a plug and in one embodiment, the plug has an exterior thread that mates with a female thread on an interior wall of the port housing. Preferably, the plug is formed as part of the spray nozzle above the spray nozzle intake and desirably includes a vent hole for venting steam from the interior of the feedring. Preferably, the vent hole is large enough to accommodate a video probe that can be used to inspect the spray nozzle. Preferably, the standpipe extends into the port housing.

In still another embodiment, the standpipe is an inverted J-tube with a curve of the inverted J-tube extending from an opening in a top surface of the feedring, turning 180°, back through the top surface, through the interior of the feedring and down through the bottom of the feedring. Preferably, the curve of the inverted J-tube is centered around the top surface of the feedring, with a horizontal line drawn between each side of the curve at an acute angle to a circumferential, horizontal line drawn along a center of the top surface of the feedring.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENT

Figure 1:
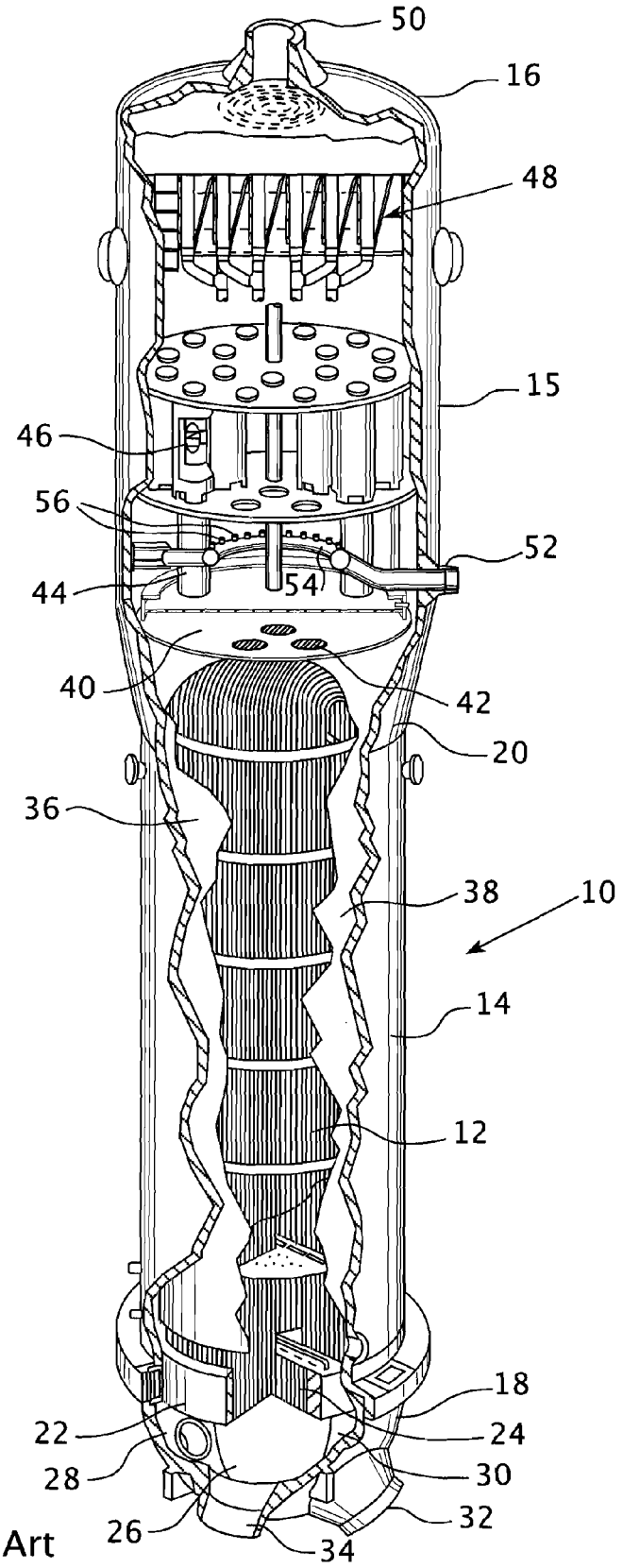
FIG. 1 Prior Art
FIG. 1 is a perspective view, partially cut away, of a vertical tube and shell axial flow steam generator.

Referring now to the drawings, FIG. 1 shows a steam or vapor generator 10 that utilizes a plurality of U-shaped tubes which form a tube bundle 12 to provide the heating surface required to transfer heat from a primary fluid to vaporize or boil a secondary fluid. The steam generator 10 comprises a vessel having a vertically oriented tubular lower shell portion 14, a generally cylindrical upper shell portion 15 and a top enclosure or dished head 16 enclosing the upper end and a generally hemispherical shaped channel head 18 enclosing the lower end. The lower shell portion 14 is smaller in diameter than the generally cylindrical upper shell portion 15 and a frustoconical shaped transition 20 connects the upper and lower portions. A tube sheet 22 is attached to the channel head 18 and has a plurality of holes 24 disposed therein to receive ends of the U-shaped tubes. A dividing plate 26 is centrally disposed within the channel head 18 to divide the channel head into two compartments 28 and 30, which serve as headers for the tube bundle. Compartment 30 is the primary fluid inlet compartment and has primary fluid inlet nozzle 32 in fluid communication therewith. Compartment 28 is the primary fluid outlet compartment and has a primary fluid outlet nozzle 34 in fluid communication therewith. Thus, primary fluid, i.e., the reactor coolant, which enters fluid compartment 30 is caused to flow through the tube bundle 12 and out through outlet nozzle 34.

The tube bundle 12 is encircled by a wrapper 36, which forms an annular passage 38 between the wrapper 36 and the lower shell 14 and frustoconical transition cone 20. The top of the wrapper 36 is covered by a lower deck plate 40 which includes a plurality of openings 42 in fluid communication with a plurality of riser tubes 44. Swirl vanes 46 are disposed within the riser tubes to cause steam flowing therethrough to spin and centrifugally remove some of the moisture contained within the steam as it flows through the primary centrifugal separator. The water separated from the steam in this primary separator is returned to the water pool above the lower deck plate 40. After flowing through the primary centrifugal separator, the steam passes through a secondary separator 48 before reaching a steam outlet nozzle 50 centrally disposed in the dished head 16.

The feedwater inlet structure of this generator includes a feedwater inlet nozzle 52 having a generally horizontal portion called a feedring 54 and discharge nozzles 56 elevated above the feedring. Feedwater, which is supplied through the feedwater inlet nozzle 52, passes through the feedring 54, and exits through discharge nozzles 56 and mixes with water which was separated from the steam and is being recirculated. The mixture then flows down over the lower deck plate 40 and into the annular passage 38 which is also known as the downcomer region. The water then enters the tube bundle at the lower portion of the wrapper 36 and flows among and up the tube bundle where it is heated to generate steam.

Figure 2:
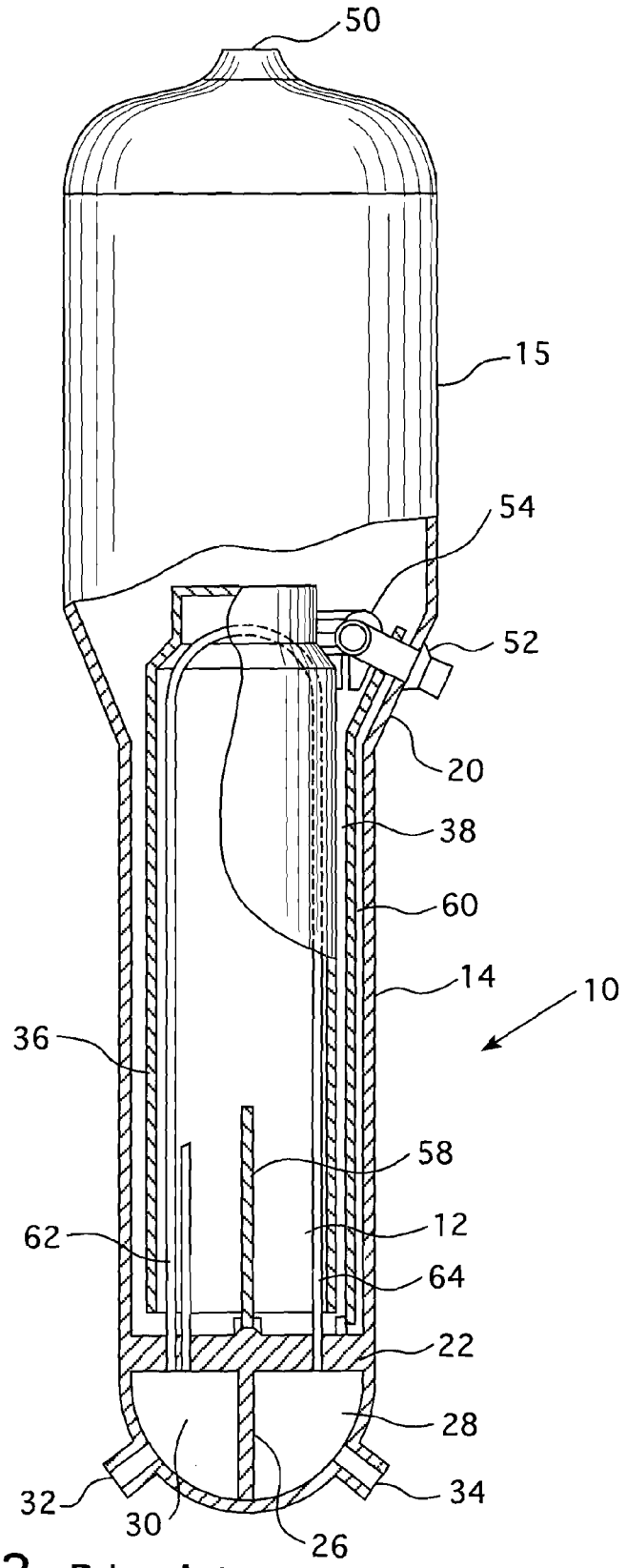
FIG. 2 Prior Art
FIG. 2 is an elevational view, partially in section, of a prior art steam generator showing the divider plate in the hemispherical head that separates the inlet channel from the outlet channel on the primary side and a partition plate extending upwardly from the tube sheet that separates the hot leg flow from the cold leg flow.

FIG. 2 is a variation on the steam generator of FIG. 1 that has a preheat section that preheats the cooler portion of the downcomer flow before it merges with the hot leg side of the tube bundle 12. In many respects, the preheat steam generator of FIG. 2 is constructed the same as that described for the steam generator illustrated in FIG. 1 except a partition plate 58 is provided on the secondary side of the steam generator, across the center tube lane between the lower parts of the hot legs 62 and the cold legs 64 of the heat exchange tubes of the tube bundle 12. The partition plate 58 extends vertically between the legs of the tube bundle and is fixed at its lower end to the tube sheet 22, extending across the full diameter of the tube sheet within the wrapper 36. Additionally, a downcomer skirt 60 is inserted in the annulus between the combination of the shell 14 and the transition 20, and the wrapper 36, around the cold leg portion of the tube bundle 64, extending over an arc of approximately 160°, with walls connecting the skirt 60 to the wrapper 36 over the height of the wrapper at both circumferential ends. The nearly semicircular feedring 54 is situated at the top of the skirt annulus 38 and distributes the feedwater directly in the annulus that spans around the cold legs 64 of the tube bundle 12. In most other respects, the preheat generator of FIG. 2 may be considered the same as that shown for the steam generator illustrated in FIG. 1. Like reference characters are used in the several figures to refer to corresponding components.

Axial flow preheat steam generator feedrings must evenly distribute feedwater flow over approximately 160° of a steam generator's upper shell circumference to be efficient. This serves to introduce the colder feedwater into the cold leg side of the tube bundle, whereby the preheating benefit of increased heat transfer occurs. One prior art preheat steam generator described in U.S. Pat. No. 6,173,680, utilized a large inverted duct to direct and distribute feedwater flow into the downcomer 38 and included a high pressure drop loose part screen within the feedring which requires access through bolted flanges to service the screen. The embodiments described herein provide a more efficient feedring design that will achieve the same objective with a reduced pressure drop through the feedring by providing a larger total area for loose parts screening, while directing fluid into the cold leg downcomer using a more compact arrangement.

Figure 3:
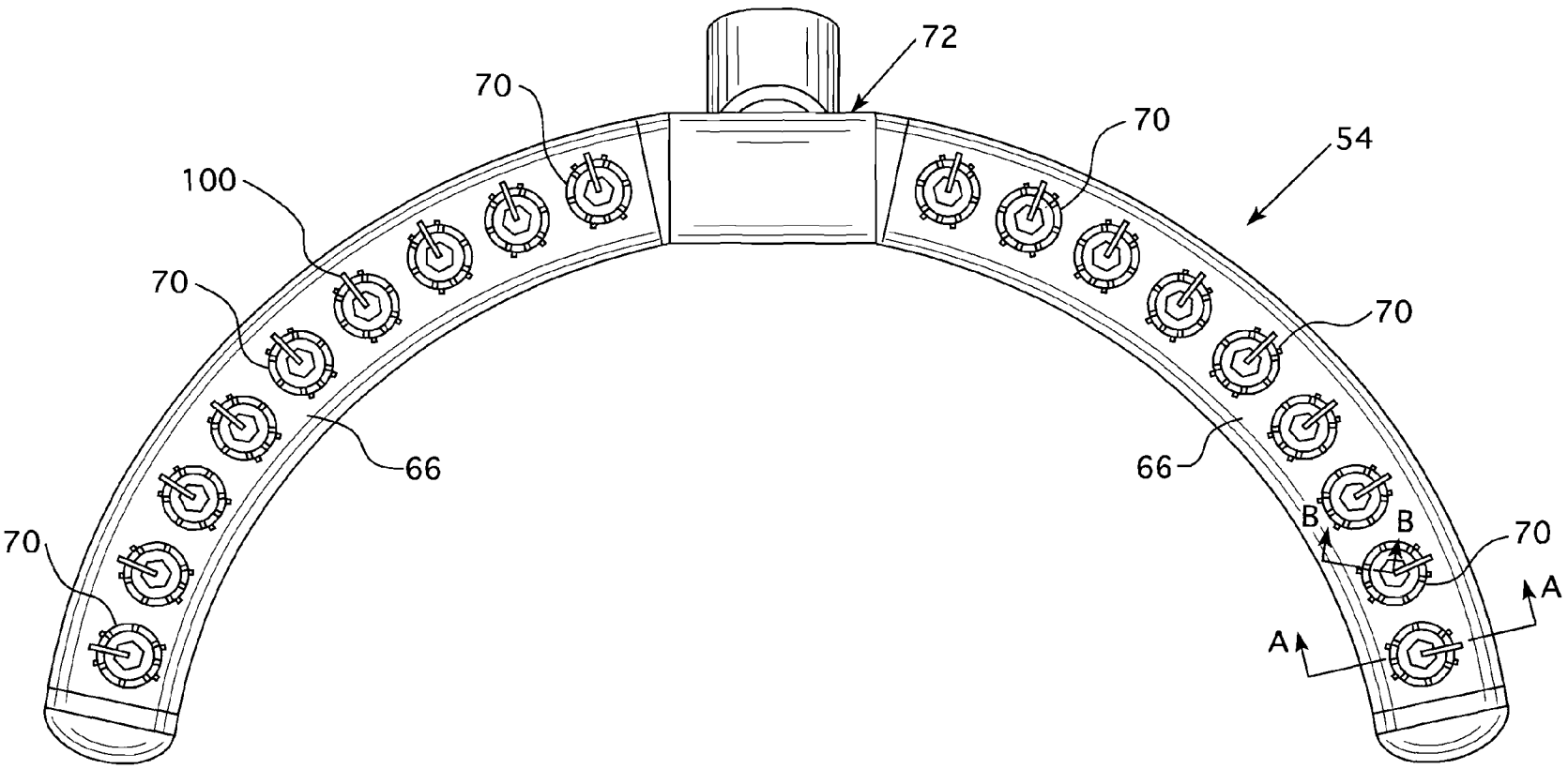
FIG. 3 is a plan view of a steam generator feedwater distribution feedring.

In one embodiment, a feedring design is provided for application with an axial flow preheat U-tube steam generator which effectively provides features for evenly distributing feedwater around an approximate arc of 160°, which minimizes the potential for stratification and water hammer and prevents loose parts which could enter the steam generator through the feedwater nozzle, from reaching the tube bundle region 12. As can be seen in FIGS. 3-9, a standpipe 68 is provided internal to the feedring 54 with removably spray nozzles 70 to direct the flow of feedwater into the cold leg downcomer annulus 38. FIG. 3 is a plan view of a feedring 54 having a feedwater distribution pipe 66 extending in an arc from either side of an inlet "T" 72. Eighteen removable spray nozzle assemblies 70 are shown extending through the top and evenly distributed around the curved feedwater distribution pipes 66. FIG. 10 shows a sectional view of one of the multiple standpipes 68 at each of the spray nozzle assembly locations identified in FIG. 3, though, it should be appreciated that the number of spray nozzles may vary. It is anticipated that there will be approximately ten to twenty spray nozzle assemblies 70 on each side of the feedwater ring "T" 72. The standpipe 68 is welded full circumference into the feedring semicircular torus on the bottom of the pipes 66, and the top end of the standpipe is open to receive flow entering from the feedwater ring via the feedwater nozzle 52. FIG. 8 provides a perspective side view of the feedring illustrated in FIG. 3.

Figure 4:
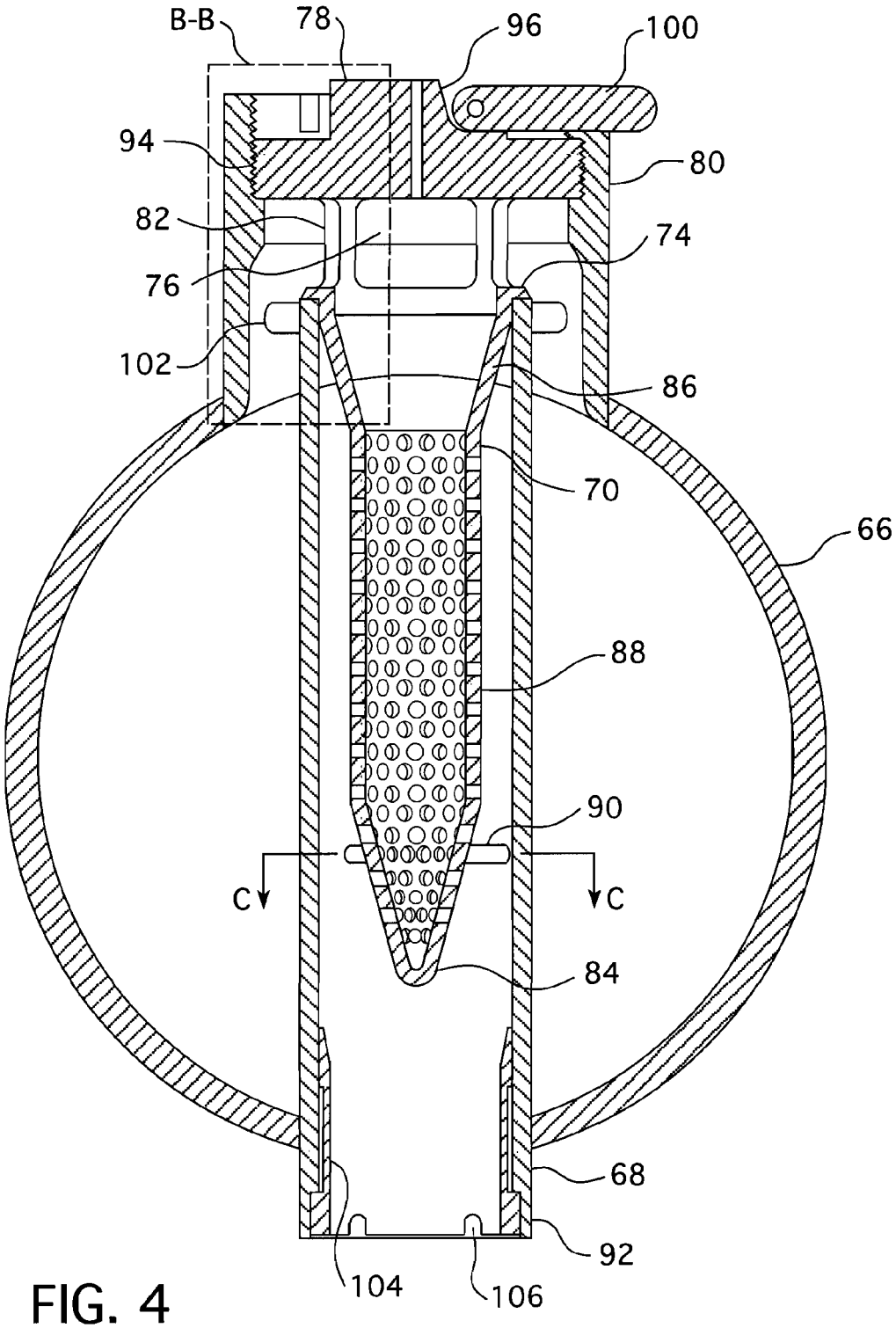
FIG. 4 is cross section of the feedring shown in FIG. 3 taken along the lines A-A thereof.
Figure 5:
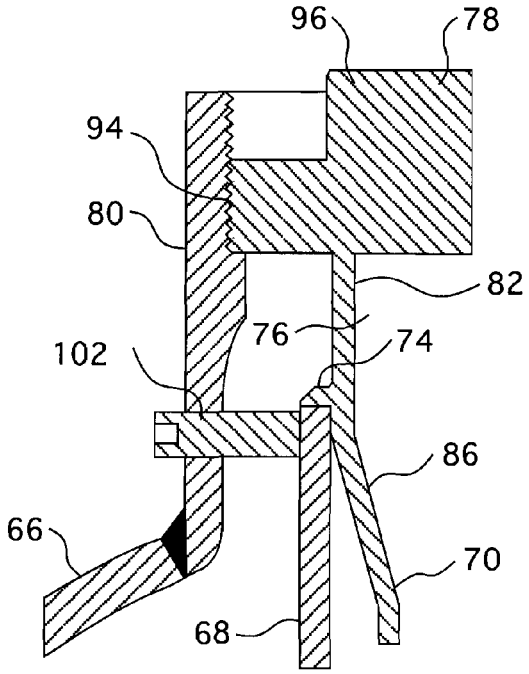
FIG. 5 is a cross section of the port housing on the feedring of FIG. 3 taken along the lines B-B thereof.
Figure 6:
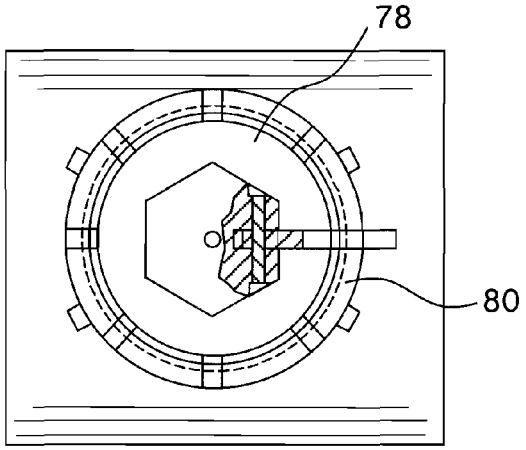
FIG. 6 is a plan view of the port housing shown in FIG. 4.

FIG. 4 shows one embodiment of a cross section of the feedring distribution pipe 66 taken along the lines A-A of FIG. 3. Similar cross sections can be found in FIGS. 11 and 15, providing different perspectives of similar embodiments. From these figures it can be appreciated that the spray nozzle 70 has a flange 74 just below the feedwater intake 76. An end plug 78 is attached on top of the feedwater intake 76 and is designed to seal an opening in the flow nozzle port 80. The flow nozzle port 80 is a vertical extension of an opening in the top of the feedwater distribution pipes 66 that is sized to access the flow nozzle 70 for servicing. The end plug 78 is attached to the flow nozzle intake with several circumferentially spaced vertically extending struts 82 which can be observed from FIGS. 4 and 5. FIG. 5 is a sectional view taken along the lines B-B of FIG. 4 and provides a better view of the flange 74, feedwater intake 76 and end plug 78.

Figure 7:
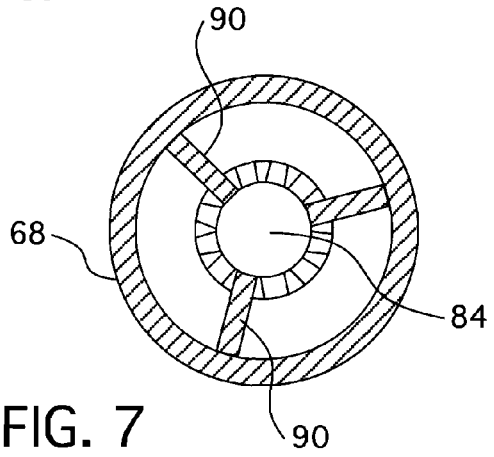
FIG. 7 is a cross sectional view of the feedwater spray nozzle taken along the lines C-C thereof in FIG. 4.
Figure 8:
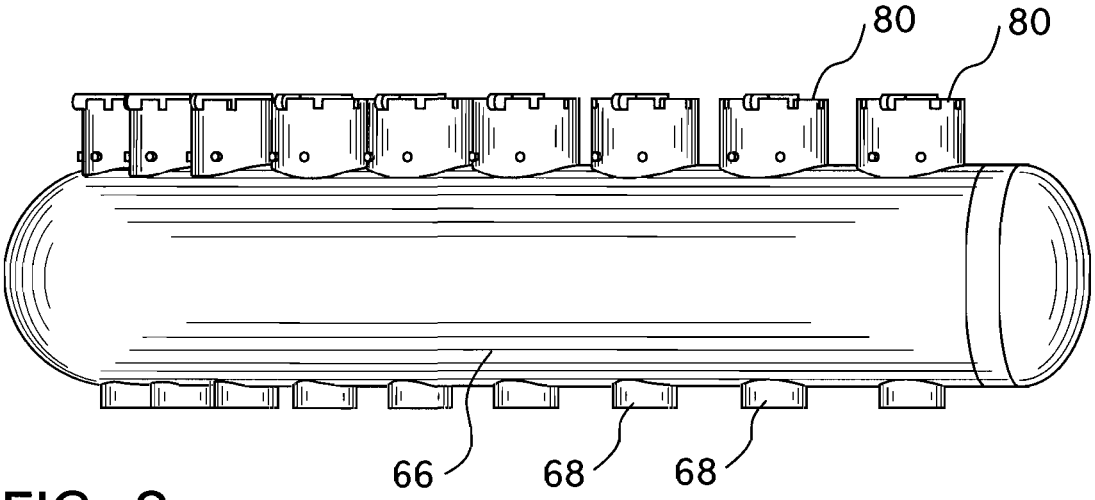
FIG. 8 is an elevational view of the feedwater feedring shown in FIG. 3.
Figure 9:
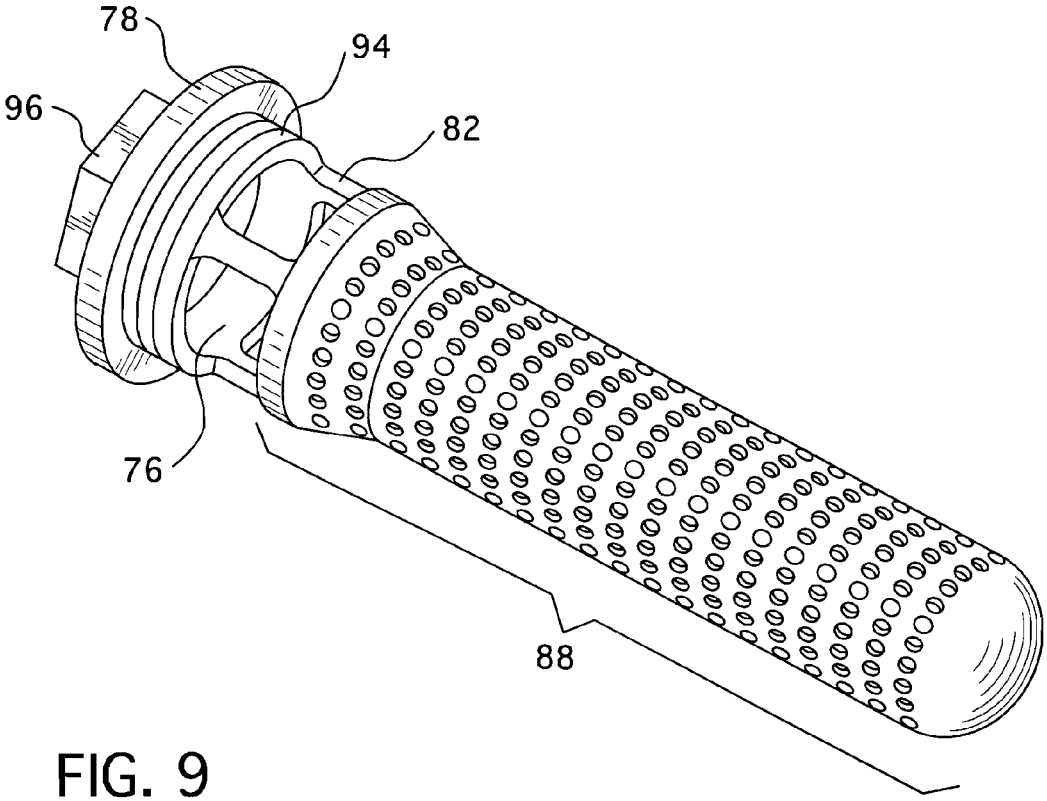
FIG. 9 is a perspective view of a spray nozzle/loose part collector assembly.
Figure 10:
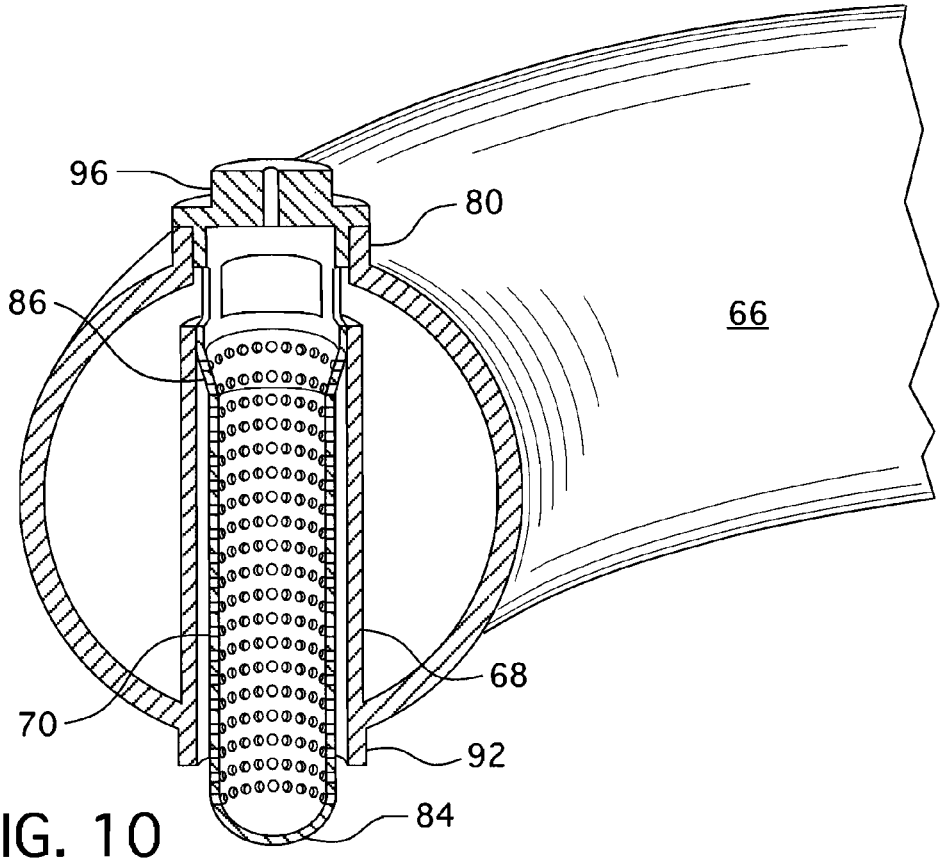
FIG. 10 is a cross section through the spray nozzle as it is assembled into the feedring port and standpipe.
Figure 11:
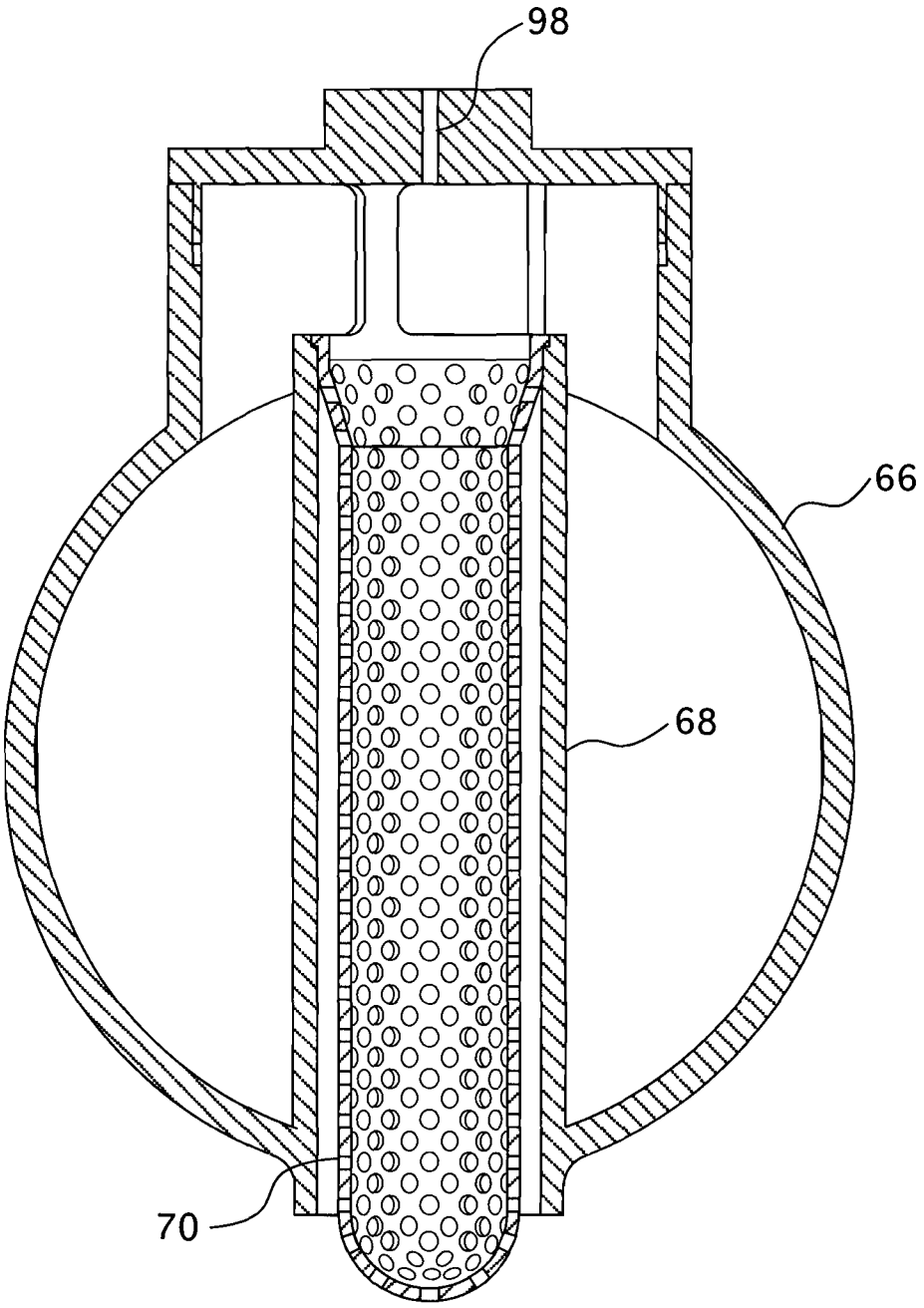
FIG. 11 is a cross sectional view of the spray nozzle showing the standpipe length increase such that the top of the standpipe extends above the top inside diameter of the feedring pipe.

The spray nozzle is fully shown in FIGS. 4, 9, 10, 11 and 15 with the cross section of the lower portion of the spray nozzle taken along the lines C-C of FIG. 4 shown in FIG. 7. The spray nozzle 70 is of generally tubular construction with converging opposing walls 86 that space the perforated side walls 88 of the flow nozzle 70 from the opposing sidewalls of the standpipe 68. The lower end 84 of the flow nozzle 70 may be supported laterally against vibration by the radially extending rods 90 which extend between the walls of the standpipe 68 and the lower perforated section of the flow nozzle as may be seen in FIGS. 4 and 7. The lower end of the flow nozzle 84 may be recessed within the lower end of the standpipe 92 as shown in FIG. 4 or the lower end 84 may extend out of the lower end of the standpipe as illustrated in FIGS. 10 and 11. FIG. 9 shows a spray nozzle/loose part collector assembly. This single piece unit has a threaded end 94 between the end plug 78 and the feedwater intake 76, for assembly into complimentary threads on the interior of the spray nozzle port 80 on the top of the feedring 54. A hexagonal head 96 provides for installation and torquing of spray nozzle into the opening on the port 80. The perforated filtering section 88 is attached to the threaded cap end by three or more strut elements 82 formed from the spray nozzle cylinder. In between the three or more supporting elements 82 are open regions 76 through which feedwater passes into the center of the spray nozzle assembly before exiting through the holes, i.e., the perforations, and then, in the preferred embodiment, into the standpipe 68.

FIG. 10 shows a cross section through the spray nozzle 70 as it is assembled into the feedring port 80 and standpipe 68. The spray nozzle 70 may be supported by lateral and/or vertical bracing elements 90 within the stand pipe to reduce vibration (as previously described with regard to FIG. 7). Flow passes through the holes in the spray nozzle, which are substantially evenly distributed, but may vary in size. The flow then moves generally downward through the annular region between the spray nozzle and the inside diameter of the standpipe. Once installed, the spray nozzle is secured from rotation by welding or other fastening techniques. The perforations in the walls 88 should be small enough to capture debris within the spray nozzle that could get caught along the tubes in the tube bundle 12.

It should be appreciated that the spray nozzle may be conical, as shown in FIG. 4, rather than cylindrical as shown in FIGS. 9, 10 and 11 or may assume a combination of those configurations as illustrated in FIG. 4. Additionally, the spray pipe 88 may be lengthened as shown in FIGS. 10 and 11 or shortened as shown in FIG. 4, as needed, to satisfy the thermal and hydraulic considerations of the application. Further, the supporting elements 90 on the spray nozzle may be deleted, and the spray nozzles attached to the standpipe directly. A separate plug/cap 78 could then be provided for the opening to the port 80. The standpipe may also be provided with teardrop shaped trailing edges to reduce pressure drop, or with plates spanning tangentially to two adjacent standpipes to reduce flow resistance. A small opening 98 may be provided in the top of the end plug of the spray nozzle to aid venting and/or inspection of the spray nozzle through insertion of a video probe.

FIG. 11 is another cross sectional view of the spray nozzle 70 showing the standpipe 68 length increased such that the top of the standpipe extends above the top inside diameter of the feedring pipe 66. This arrangement ensures that the feedring pipe 66 remains completely filled with water even when the water level is lowered on the secondary side of the generator below the elevation of the feedring 54 (provided there is no leakage through the feedwater nozzle).

As may be appreciated from FIGS. 3 and 4, a gravity held locking tab 100 may be provided which fits into slots at the top of the port pipe 80 and in end cap 78 to prevent the end cap 78 from rotating instead of using welds as previously mentioned. Four centering pins 102 may be provided through the port pipe 80 as shown in FIGS. 4 and 5 to further support the standpipe 68. These pins are welded after assembly. A threaded end thermal sleeve 104 is installed in the bottom 92 of the standpipe 68. Slots 106 on the thermal sleeve 104 are used to turn the sleeve into the female threads in the standpipe. The thermal sleeve may be used to reduce thermal gradients at the juncture of the standpipe and the feedring.

Figure 12:
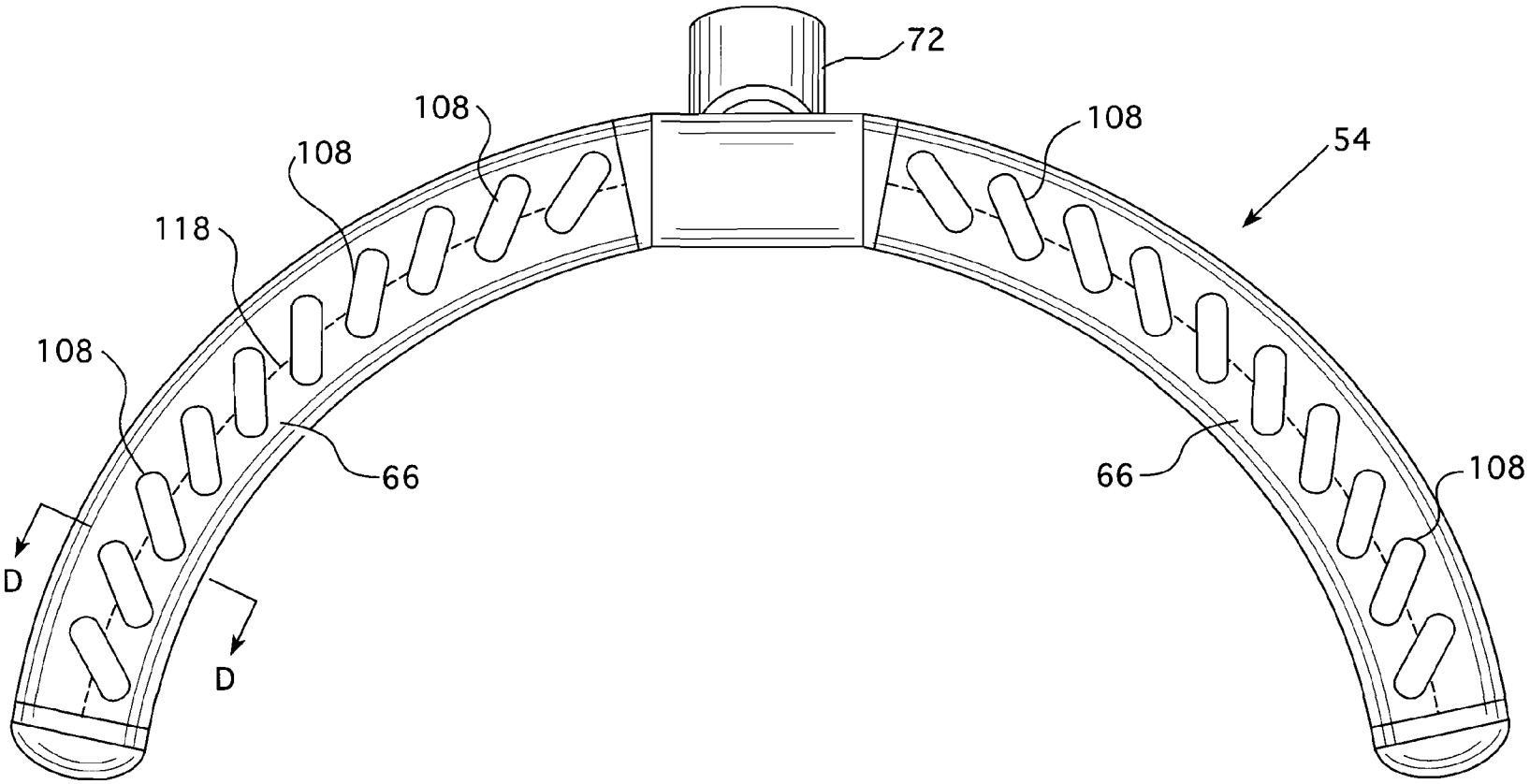
FIG. 12 is a plan view of a second embodiment of a feedwater feedring that employs J-tube distribution nozzles.
Figure 13:
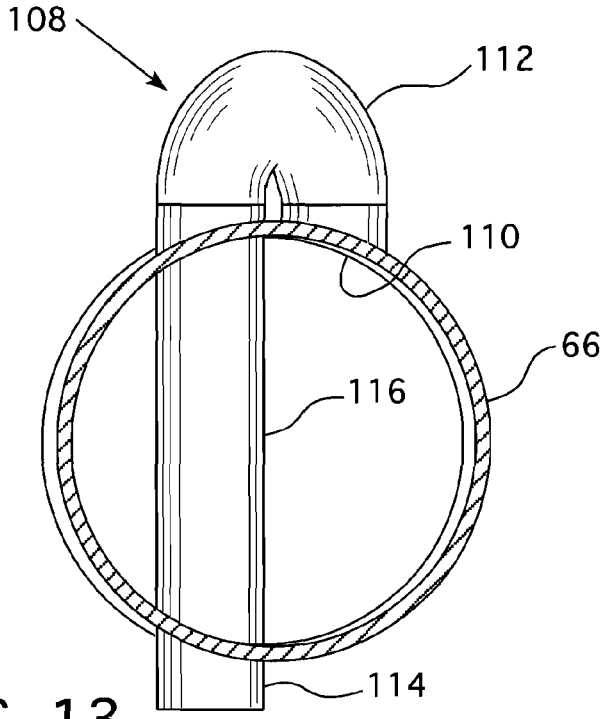
FIG. 13 is cross sectional view taken along the lines D-D of FIG. 12.
Figure 14:
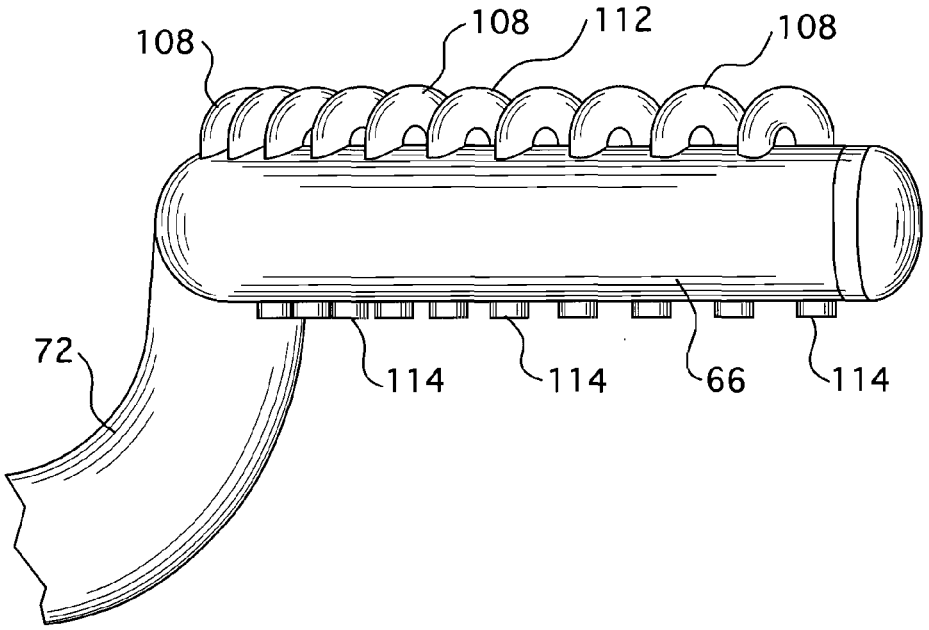
FIG. 14 is a side view of the feedwater ring illustrated in FIG. 12.

FIGS. 12 through 14 illustrate another embodiment of this concept that employs J-tubes as the standpipes. FIG. 12 is a plan view of this embodiment similar to that previously described with regard to FIG. 3. FIG. 14 is a side view similar to that previously provided in FIG. 8. As previously stated, like reference characters are used in the several figures to refer to corresponding components. The J-tubes 108 replace the standpipe 68/nozzles 70 arrangement of the embodiments described above. An open end 110 of the curved section 112 of the J-tube 108 forms the intake through which feedwater flowing through the interior of the feedring distribution pipe 66 enters the J-tube. The tight curve on the curved section 112 and gravity discourage loose parts entrained in the feedwater from entering the J-nozzle opening 110. The straight section of the J-tube 116 passes from just above the top of the feedwater distribution pipe 66 through the interior of the feedwater distribution pipe 66 and terminates in a discharge end 114 at the lower end of or just below the distribution pipe 66. As can be seen from FIG. 13, the curved section 112 of the J-tube is oriented at an acute angle to a circumferential line 118 passing through the center of the top of the distribution pipe 66.

Figure 15:
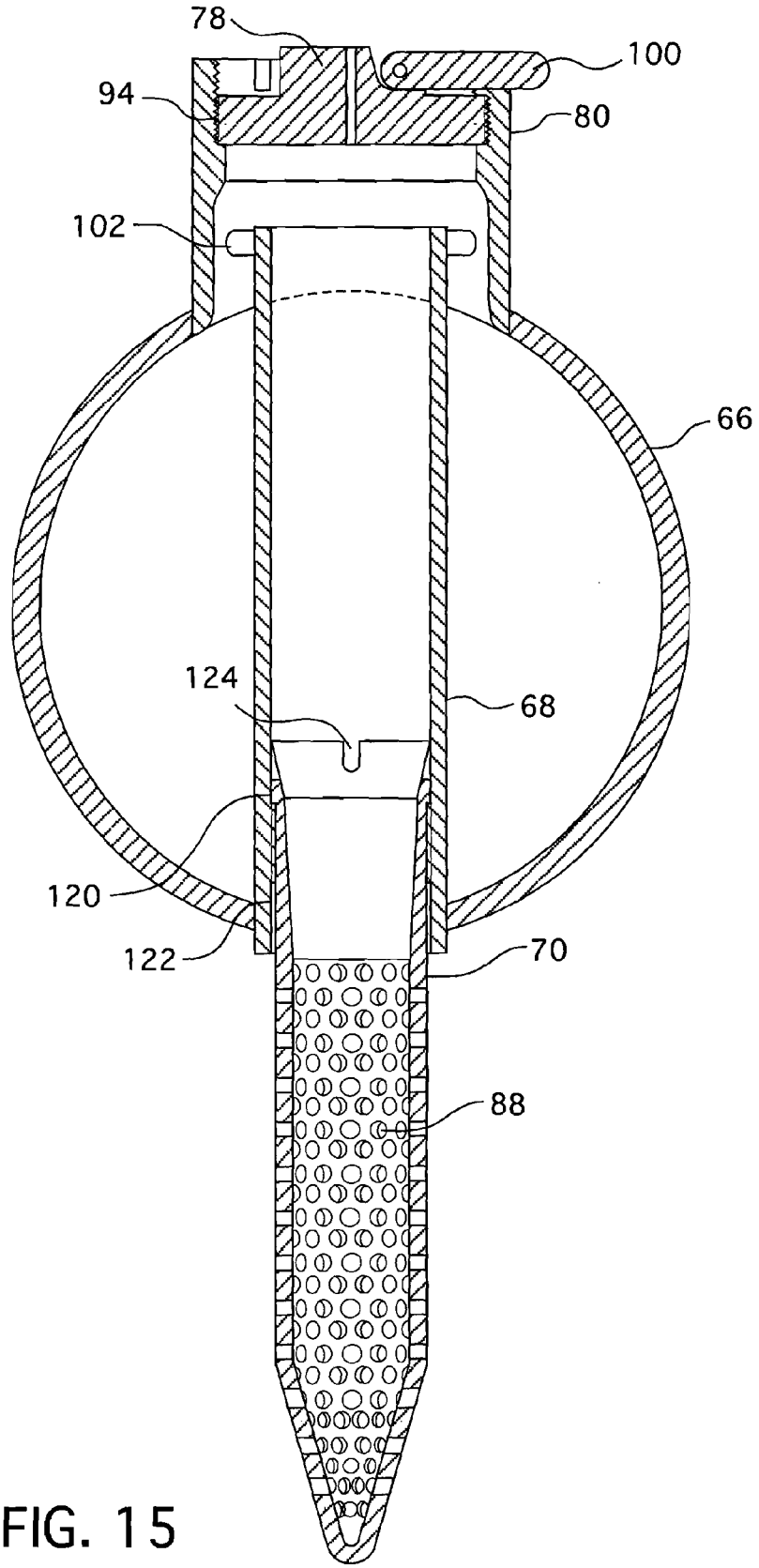
FIG. 15 is a cross section of the feedring shown in FIG. 3, similar to FIG. 4, with the spray nozzle lowered into the bottom of the standpipe.

FIG. 15 illustrates still another embodiment of the feedring that provides a reduced pressure drop through the feedring system. The figure shows the spray nozzle 70 lowered into the bottom of the standpipe 68. The upper end of the spray nozzle is stopped from further insertion by a small ledge 120 in the standpipe bore. There are male threads 122 on the outside diameter of the spray nozzle that fit into female threads at the bottom of the standpipe. U-shaped cutouts 124 in the top edge of the spray nozzle aid in rotating the spray nozzle in and out of the standpipe.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A steam generator comprising:

a primary side including:

an inlet chamber for receiving a heated primary fluid;

an outlet chamber for returning the primary fluid to a heating source;

a tube sheet forming at least one wall of the inlet chamber and at least one wall of an outlet chamber;

a plurality of heat exchange tubes respectively having first and second ends and an intermediate extent, with the first ends extending through the tube sheet and opening into the inlet chamber and the second ends extending through the tube sheet and opening into the outlet chamber with the intermediate extent passing through and in heat exchange relationship with a secondary side;

the secondary side including;

a generally cylindrical outer shell have a central axis;

a generally cylindrical wrapper supported above at least a portion of the tube sheet, within, spaced from and coaxially positioned with respect to the shell and forming a downcomer region between at least part of the wrapper and the shell;

a feedring positioned above the downcomer region for introducing feedwater into the downcomer region, the feedring having a water passage within the feedring, the water passage having a substantially constant diameter substantially around an entire interior length, except in a location of a standpipe wherein the diameter of a portion of a circumference of the water passage is enlarged;

a plurality of the standpipes are spaced circumferentially along the feedring in a direction of feedwater flow, with the standpipes extending vertically from a lower portion of an interior of the feedring upward through the interior of the feedring and having a feedwater intake only in an upper portion of the feedring, substantially above a middle elevation, with substantially all of the feedwater entering the standpipes entering from the feedwater intakes in the upper portion of the feedring at substantially the same elevation within the feedring and a feedwater discharge at or below a bottom of the feedring, for distributing the feedwater into the downcomer region; and a spray nozzle suspended within the standpipe.

2. The steam generator of claim 1 wherein the spray nozzle is a generally tubular member with perforated side walls, a closed lower end and an intake near the upper portion of the interior of the feedring.

3. The steam generator of claim 2 wherein the perforations in the spray nozzle side walls are arranged substantially uniformly over the side wall.

4. The steam generator of claim 2 wherein the perforated side walls of the spray nozzle are spaced from an opposing interior side wall of the standpipe.

5. The steam generator of claim 4 wherein portions of the side walls of the spray nozzle converge towards an opposing wall of the spray nozzle as the walls of the spray nozzle extend towards the lower end.

6. The steam generator of claim 4 wherein a lower portion of the spray nozzle is supported from the opposing interior side walls of the standpipe.

7. The steam generator of claim 2 wherein the nozzle is supported from the top of the standpipe.

8. The steam generator of claim 2 wherein the perforations are sized to trap debris of a preselected size.

9. The steam generator of claim 2 wherein the feedring includes a port housing having walls that extend upward from a top surface of the feedring, in line with the spray nozzle and through which the spray nozzle can be serviced.

10. The steam generator of claim 9 wherein a top of the port housing is substantially closed with a plug.

11. The steam generator of claim 10 wherein the plug has an exterior thread that mates with a female thread on an interior wall of the port housing.

12. The steam generator of claim 10 wherein the plug is formed as an integral part of the spray nozzle above the spray nozzle intake.

13. The steam generator of claim 10 wherein the plug includes a vent hole for venting steam from the interior of the feedring.

14. The steam generator of claim 13 wherein the vent hole is large enough to accommodate a video probe that can be used to inspect the spray nozzle.

15. The steam generator of claim 9 wherein the standpipe extends into the port housing.

16. The steam generator of claim 1 wherein at least some of the standpipes are removeably supported within the feedring, including a locking mechanism having an open and a closed position and in the closed position locking the standpipe in position within the feedring.

17. The steam generator of claim 1 including a thermal sleeve closely received within a lower portion of at least some of the standpipes, proximate the bottom of the feedring, for reducing thermal gradients at a juncture of the standpipes and the feedring, with male threads on an outside surface of the thermal sleeve supported within female threads on an inside surface of the standpipe.

* * * * *